US007182294B2

(12) United States Patent
Blackman

(10) Patent No.: US 7,182,294 B2
(45) Date of Patent: Feb. 27, 2007

(54) KITE SURFING BAR

(76) Inventor: William E. Blackman, 102 Coral Rd., Boynton Beach, FL (US) 33435

( * ) Notice: Subject to any disclaimer, the term of this patent is extended or adjusted under 35 U.S.C. 154(b) by 133 days.

(21) Appl. No.: 11/008,422

(22) Filed: Dec. 9, 2004

(65) Prior Publication Data

US 2005/0121556 A1 Jun. 9, 2005

Related U.S. Application Data

(60) Provisional application No. 60/528,446, filed on Dec. 9, 2003.

(51) Int. Cl.
*A63H 27/00* (2006.01)

(52) U.S. Cl. ..... 244/155 A

(58) Field of Classification Search ..... 244/153 R, 244/154, 155 R, 155 A, 153 A; 441/69; 280/810
See application file for complete search history.

(56) References Cited

U.S. PATENT DOCUMENTS

| | | | | | |
|---|---|---|---|---|---|
| 2,388,478 | A * | 11/1945 | Garber | 244/155 A |
| 3,018,753 | A * | 1/1962 | Price | 441/69 |
| 3,148,655 | A * | 9/1964 | Brant | 441/69 |
| 3,830,188 | A * | 8/1974 | Humbert | 441/69 |
| 4,892,272 | A | 1/1990 | Hadzicki | 244/153 R |
| 5,026,007 | A | 6/1991 | Gellert | 244/155 A |
| 5,120,081 | A | 6/1992 | Longoria et al. | 280/810 |
| 5,180,123 | A | 1/1993 | Lin | 244/155 A |
| 5,366,182 | A | 11/1994 | Roeseler | 244/155 R |
| 5,595,136 | A * | 1/1997 | Shinsky | 114/253 |
| 6,095,880 | A * | 8/2000 | Giunta | 441/69 |
| 6,273,369 | B1 | 8/2001 | Nishimura | 244/155 A |
| 6,513,759 | B2 | 2/2003 | Starbuck | 244/155 A |
| 6,514,115 | B2 | 2/2003 | Harich | 446/34 |
| 2002/0084384 | A1 * | 7/2002 | Bellacera | 244/155 A |
| 2004/0182968 | A1 * | 9/2004 | Gentry | 244/155 A |

OTHER PUBLICATIONS www.zblog.com/kite/kitebar.html (available on the web Aug. 11, 2003).*
Listing of Kitesurfing Web Sites, Including: www.airbrush.com.
www.cabrinhakites.com
Listing of Kitesurfing Web Sites Continued: www.cautionkites.com.
www.clamcleat.com.
www.dakine.com.

(Continued)

*Primary Examiner*—Teri Pham Luu
*Assistant Examiner*—Edward J. Mayle
(74) *Attorney, Agent, or Firm*—Gifford, Krass, Groh, Sprinkle, Anderson & Citkowski, P.C.

(57) ABSTRACT

An apparatus for controlling movement of a flying device, such as a kite. In controlling such movement, the apparatus comprises a series of force transmitting members associated with a control bar to be grasped by an operator. Such association minimizes interference of the force transmitting members with the control bar surface so as to heighten the level of control that the operator may exert over the kite. Such association also permits the operator to achieve, through movement of the control bar, selective adjustments in both the velocity and acceleration at which the kite and the operator are able to move in a single direction.

10 Claims, 2 Drawing Sheets

OTHER PUBLICATIONS www.nsipadz.com.
www.fanatic.com.
www.gaastrakites.com.
www.usakite.com.
www.jimmylewis.com.
www.litewavedesigns.com.
www.naishkites.com, maybe.
www.northsports.com.
Listing of Kitesurfing Web Sites Continued: www.rainbowfins.com.
www.robertoriccidesigns.com.
www.cabaldc.com.
www.slingshotkiteboarding.com.
www.speedtech.com.
www.takoon.com.
www.wipikakiteboarding.com.
www.bestkiteboarding.com.
Sheet Displaying Illustrations Explaining: Sample Kite Bar By DePower Sample Pully Bar by Airbrush, Sample Text From Kiteboarding Magazine, Date of Publication of Sheet Displaying Illustration at Least as Early as Nov. 5, 2004.

* cited by examiner

KITE SURFING BAR

REFERENCE TO RELATED APPLICATION(S)

This application claims priority of U.S. provisional patent application Ser. No. 60/528,446 filed Dec. 9, 2003, the entire content of which is incorporated herein by reference.

BACKGROUND OF THE INVENTION

1. Field of the Invention

This invention relates to the sport of kite surfing, and more particularly, to a control apparatus that eases maneuverability of the kite and which also provides an ability to selectively adjust both the velocity and acceleration at which the kite sails.

2. Description of Related Art

Kite surfing is a sport of growing popularity among those who enjoy water sports. Enthusiasts engaging in the sport use a connected kite to capture energy created by the wind to then propel their movement across the surface of the water, all while standing on a small board much akin to a surfboard. Such sportsmen, or surfers, endeavor to accomplish highly acrobatic maneuvers. These maneuvers often require great individual skill and control of the kite.

To control the kite, it is necessary that the kite surfing equipment include a control bar. The control bar provides both a point of connection between the kite and the surfer, as well as the device that the surfer uses to adjust his or her movement relative to the water surface.

In achieving the above connection, the control bar is usually linked to the kite by a series of control lines, and to the surfer by a harness that couples to a belt or vest worn around his or her waist. Past designs of such linkage have often involved the passage of at least one of those lines directly through the surface of the control bar at the longitudinal center thereof. In the experience of many surfers, the passing of any control line through the surface of the control bar at that point interferes with an ability to freely move his or her hands fully across the control bar. Consequently, the particular range of surfing maneuvers requiring the ability to have such freedom of movement are greatly decreased, as is the enjoyment provided by the flexibility to quickly switch from the performance of one maneuver to another, say for example, while the surfer is airborne.

To adjust his or her movement while surfing, the surfer merely places his or her hands on the control bar and moves it in a desired direction, thereby steering the control lines, and thus the attached kite in the same general direction. As the positioning of the kite changes, the velocity and acceleration at which the surfer moves typically change as a result of the strength of the wind impacting the kite and the angle at which that impact occurs. Velocity, as is commonly understood, is movement with a certain amount of speed in a certain direction; and acceleration is simply a change in velocity over a period of time.

Past designs of control bars and their attached control lines, however, have been unable to allow the surfer to initiate, merely by a simple movement of the control bar, both an increase and a decrease in acceleration without causing a change in the surfer's travel direction. For instance, while at least one of these designs has allowed a surfer to increase his or her acceleration, a decrease in such acceleration can only be obtained by moving the control bar such that the kite is powered by the wind to a much lesser extent; whereby such movement also has the effect of changing the surfer's travel direction. Conversely, another of such control bar and line designs permits a surfer to slow the kite through movement of the control bar, but lacks an ability to have such movement make the kite sail any faster than the rate at which it is already traveling, absent an increase in the strength of the wind impacting the kite.

Thus, in view of the above, it would be desirable to provide an apparatus in which the attachment of the control lines to the control bar permits the surfer to freely use as much of the length of the control bar as is possible to control the kite. Further still, it would be desirable to provide an apparatus with which the surfer could selectively initiate an increase or decrease in the acceleration while moving in a single direction. With such a combination, a surfer would be able to maximize both the level of control, which he or she may exercise over a vast array of surfing maneuvers as well as, therefore, the level of enjoyment obtainable from his or her surfing experience.

SUMMARY OF THE INVENTION

Accordingly, there is provided an apparatus intended to maximize the level of control that a kite surfer has over a kite during its use. To do so, the apparatus minimizes the amount of structure present on the control bar surface in order to provide the surfer the ability to grasp a larger area thereof. Additionally, the apparatus provides the kite surfer the ability to initiate either an increase or decrease in the acceleration at which the kite and the surfer are able to move in a single direction.

The above apparatus comprises a series of kite control lines coupled with a control bar which the surfer grasps to control their movement. In particular, three control lines are associated with both the control bar and the kite. Two of these lines enable steering of the kite. The third line acts as a brake line to enable the kite to experience more or less power, or in other words, be accelerated or decelerated, during its use.

Association of each of the three lines with the control bar is made in a manner that consumes as little of its surface area as possible. To do so, the brake line is linked from the kite to a closed loop cable. The cable is then guided on and by a system of pulleys that route it through an interior of the control bar, instead of directly through the surface thereof. Accordingly, more area of the control bar is available for the surfer to contact with his or her hands, thereby allowing the kite to be better managed while surfing.

Further, the kite control apparatus enables the surfer to initiate an increase or decrease in the acceleration of the kite while traveling in a single direction, and advantageously, during the performance of surfing maneuvers. To do so, a surfer need only move the control bar toward or away from himself or herself to obtain the desired change in acceleration. Specifically, movement of the control bar toward the surfer provides an increase in acceleration and, conversely, movement of the control bar away from the surfer slows movement of the kite so as to provide a decrease in acceleration.

Accordingly, there is provided an apparatus for controlling a kite that maximizes the level of control that a kite surfer may exert over a kite during its use.

DESCRIPTION OF THE PREFERRED EMBODIMENT

Figure 1:
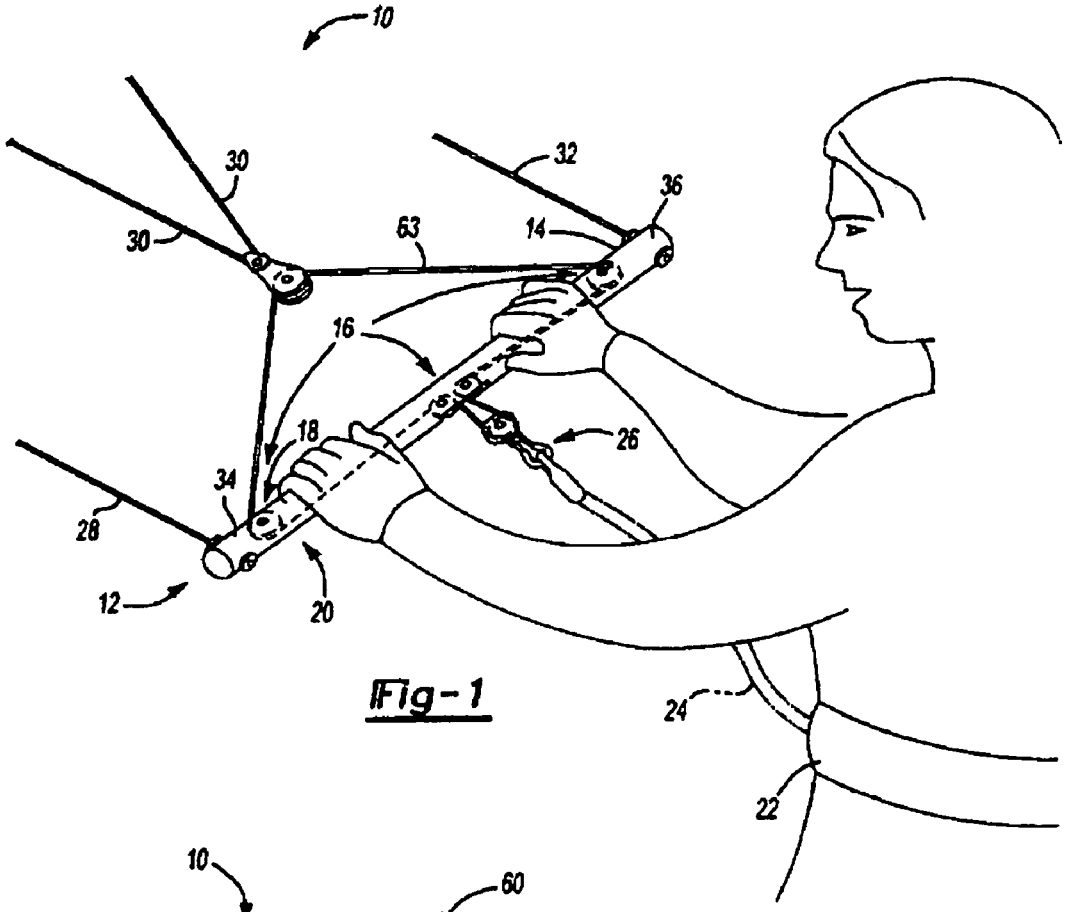
FIG. 1 is a perspective view in which a kite surfer is holding onto the kite control apparatus of the present invention.

Looking to FIG. 1, an individual is shown using an apparatus 10 for controlling a flying device, such as a kite (not shown); and which is intended for use in capturing energy created by the wind, whereby that energy is then used in powering movement of the individual. Such an individual is often referred to as a kite surfer.

Figures 2, 4:
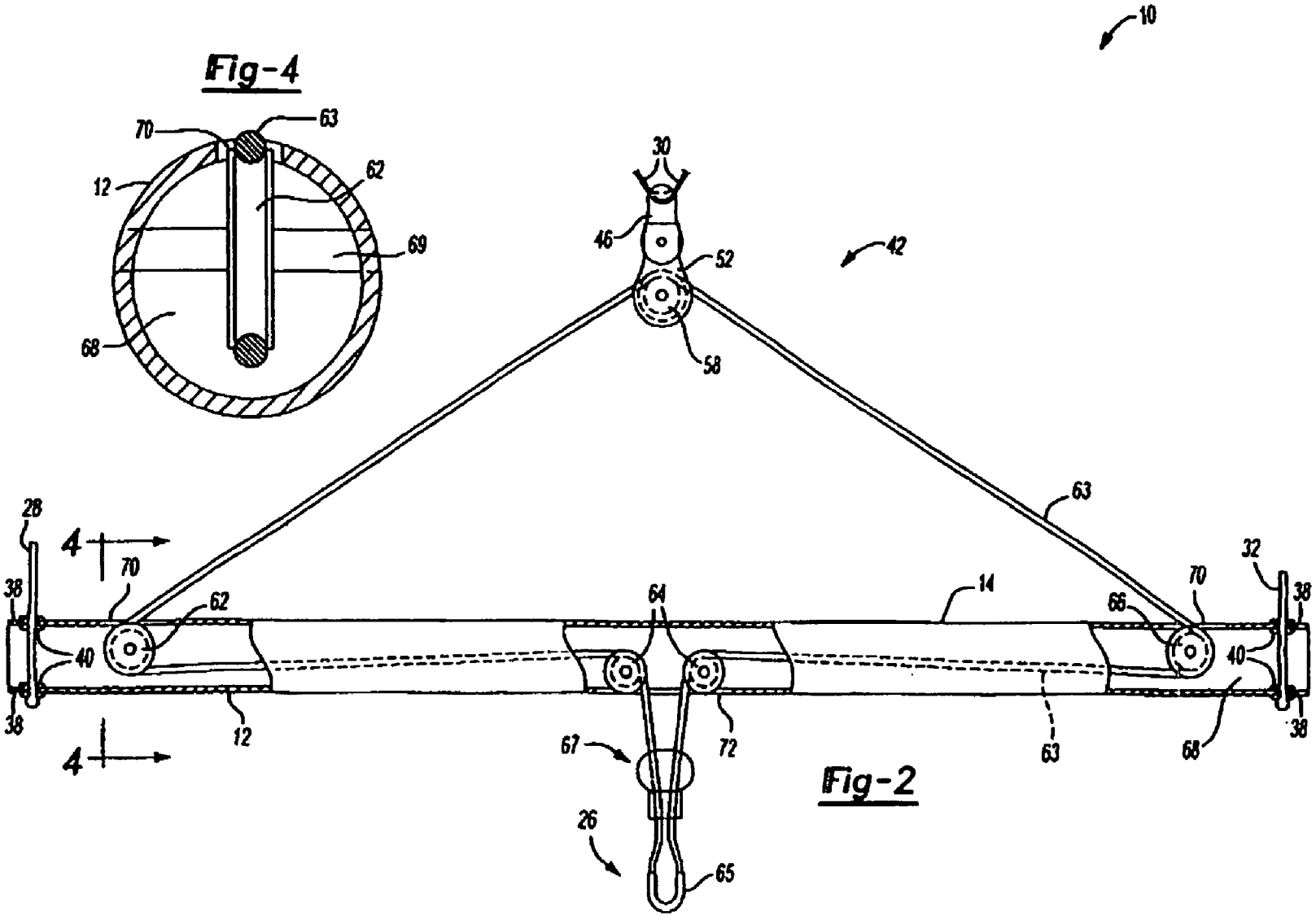
FIG. 2 is a side view of the control apparatus according to FIG. 1 in which portions thereof are cutaway to show the assembly of certain components thereof; in particular, the relationship of a closed loop cable and control bar comprising the apparatus.
FIG. 4 is a cross-sectional view taken along lines 4—4 of FIG. 2 in which the relationship of the control bar and at least one of the pulleys with which the closed loop cable is associated is shown.

The apparatus 10 comprises a main body portion that is provided as a control bar 12, preferably formed as an elongated tubular handlebar, as shown in FIGS. 2 and 4. The control bar 12 is, preferably, formed of carbon fiber so as to provide advantages including high durability and resultant longevity. Other materials, including stainless steel, brass or titanium, which provide the same or similar advantages may also be used. As may be seen in FIG. 1, the surfer obtains a stance in which both of his or her arms are outstretched from his or her torso and whose hands are grasped upon the surface 14 of the control bar 12, and specifically, within a grip region 16 having forward and rearward areas 18 and 20, respectively. Further, the surfer is shown wearing a belt 22 around his or her waist. Attached to the belt 22 is a line 24 which couples to a harnessing loop 26 extended from the control bar 12.

As shown in FIG. 1, a series of force transmitting members, or control lines 28, 30 and 32 are provided, and are associated with the control bar 12 and the kite to transfer therebetween the force(s) caused by the wind impacting the kite, in addition to the force(s) generated by movement of the control bar 12. It is obvious that the kite, although not shown, is to be attached to each of the control lines 28, 30 and 32. Two of these control lines 28 and 32 comprise left and right fly-lines, respectively, that are mounted to the control bar 12 at respective ends 34 and 36 thereof to enable steering of the kite. Further, as may be understood from each of FIGS. 1 and 4, the fly-lines 28 and 32 extend through openings 38 formed on the surface 14 of the control bar 12. Plastic grommets 40 are placed within the openings 38 such that they abut against inner and outer surfaces of the control bar 12 and receive the fly-lines 28 and 32 therethrough. As will be understood by one of ordinary skill in the art, the control bar 12 is moveable throughout a range of motion in order to permit the surfer an ability to steer movement of the kite. During such movement, the grommets 40 assist in protecting against tearing of the fly-lines 28 and 32.

With reference to both FIGS. 1 and 2, the apparatus 10 further comprises an assembly 42 that is associated with the control bar 12 for adjusting and controlling the amount of power to be generated by the kite. Included as part of that assembly 42 is brake line 30, which as shown most clearly in FIG. 2, is operatively connected with the control bar 12 such that it is free from direct contact or connection with the surface 14 of the control bar 12. Accordingly, more surface area of the control bar 12, and specifically more of the grip region 16, is available for use by a surfer to control movement of the kite than has been made available by past control bar and line designs.

In avoiding the surface contact mentioned above, the assembly 42 further comprises a pair of connections that associate the brake line 30 and the control bar 12.

Figure 3:
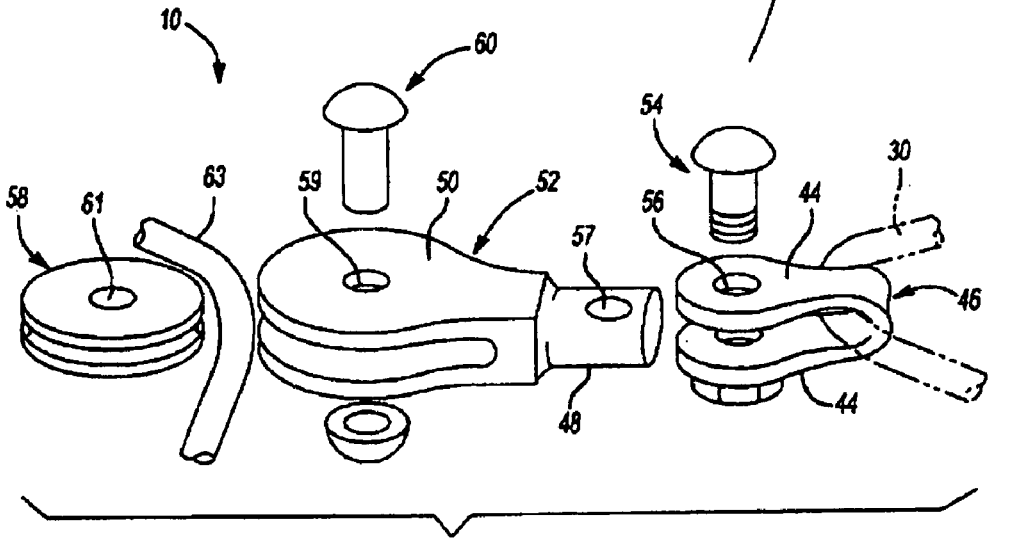
FIG. 3 is an exploded view of the assembly of the linkage of a control line used in causing an acceleration or deceleration in movement of the kite to the closed loop cable and control bar referenced in FIG. 2.

The first connection involves passing the brake line 30 through the legs 44 of an inverted U-shaped member 46, as is shown in FIG. 3. The legs 44 are attached to a projection 48 extending from a top surface 50 of a wishbone-shaped carrier 52 via a pin 54. As shown, the pin 54 is inserted in a pair of apertures 56 and 57, respectively provided in the legs 44 and the projection 48. As may be seen therein, the carrier 52 suspends a pulley 58 that is attached thereto by a connector 60 extended through apertures 59 and 61 in each of the carrier 52 and the pulley 58, respectively.

The projection 48 is mounted for rotation such that the U-shaped member 46 rotates relative to the top surface 50 of the carrier 52. Such rotation enables the brake line 30 to avoid undue twisting and knotting during use of the kite.

The second connection involves a substantially continuous medium 63 that, as shown in FIGS. 1–3, is hung from the elevated pulley 58 so as to be carried thereby. The medium is, preferably, provided as a closed loop cable that is further entrained about a series of left, middle and right pulleys 62, 64 and 66, respectively, which as shown in FIGS. 1 and 2, are disposed within an interior 68 of the control bar 12 so as to route the cable 63 below the surface thereof. When looking to FIGS. 2 and 4, it is to be understood that the elevated pulley 58 is moveable along a track defined by the closed loop cable 63, and that each of the pulleys 62, 64 and 66 is mounted on a similar shaft 69 which is fixedly attached with the interior surface of the control bar 12.

Looking to FIG. 2, there is shown a plastic ball and rubber sleeve combination 67 through which the cable 63 passes and which provides a spacing mechanism to maintain an appropriate distance between the attachment of the surfer to the harnessing loop 26 and the control bar 12. After passing therethrough, the cable 63 forms the harnessing loop 26; whereby a substantially semi-circular rubber sheath 65 covers a portion thereof.

With reference to FIGS. 3 and 4, it may be seen that the cable 63 passes through the surface 14 of the control bar 12 by way of cutouts 70 and 72 which are provided, respectively, in each of the forward and rearward areas 18 and 20 of the grip region 16. Notably, the location of these cutouts 70 and 72, and thus that of the entry and exit of the cable 63 relative to the control bar 12, permits the entire forward area 18 of the grip region 16 to be made available for use by the surfer to move his or her hands thereacross.

In recalling discussion herein, the control apparatus 10 permits a surfer to steer movement of the kite, and thus his or her direction of travel across the water surface. To do so, the surfer need only move the control bar in a certain direction, e.g., left or right, and the respective control line 28 or 32 tugs on the kite to position it relative to the direction of the impacting wind. Such a sequence ultimately translates into the direction of travel that the surfer desires.

Further, the apparatus 10 also enables the surfer to regulate the amount of power generated by the kite, and therefore, both the acceleration of it and the surfer while moving in a single direction. To increase his or her acceleration, the surfer need only move the control bar 12 toward himself or herself. As this occurs, the cable 63 traverses at least pulleys 62, 64 and 66, whereby portions thereof and the brake line 30 move upwardly and away from the control bar as a result of the impact of the wind upon the kite. More specifically, such movement of the brake line 30 allows the kite, and specifically its leading edge to which the brake line 30 is attached, to lessen resistance against the wind so as to allow the kite to catch more of the its impact, thereby causing an increase in power that provides greater acceleration. To slow down, or decrease the acceleration, the surfer need only move the control bar 12 away from himself or herself. As this occurs, the cable 63 traverses at least pulleys 62, 64 and 66, whereby portions thereof and the brake line 30 move toward the control bar 12, and against the force of the wind impacting the kite. The effect of such movement is a downward pulling by the brake line 30 on the leading edge of the kite that causes an increased resistance against the impacting wind. As a result of this increased resistance, the kite cannot be lifted by the wind as much as when the control bar 12 is moved toward the surfer. Consequently, the kite produces a decrease in power, causing a lessening in the acceleration to be experienced by the surfer.

With the advancement of cable 63 over elevated pulley 58 and remaining pulleys 62, 64 and 66, it is to be understood that the elevated pulley and the attached brake line 30 will move in unison with the directional movement of either one of the fly-lines 28 and 32. Accordingly, it is to be understood that increases or decreases in acceleration are also obtainable while the surfer turns the control bar 12, and thus the kite, for movement in a particular direction.

Preferably, each of the control lines 28, 30 and 32, as well as the closed loop cable 63, are provided as cabling constructed of nylon rope so as to provide high durability and flexibility. It is to be understood that other such materials providing similar properties and characteristics could also be used.

Accordingly, there is provided an apparatus for controlling movement of a flying device, whereby such apparatus enables greater control to be exerted over the use of the flying device.

While the foregoing describes certain preferred embodiments, it is to be recognized that one of ordinary skill in the art could adopt other forms thereof; accordingly, the scope of the invention is to be limited only by the following claims.

I claim:

1. An apparatus for controlling movement of a flying device, the apparatus comprising:

a) a main body portion defining a periphery thereof, and which is moveable throughout a range of motion;

b) a plurality of force transmitting members associated with said main body portion and adapted for connection with said flying device to transfer motion therebetween, at least one of said force transmitting members being free of direct connection with said main body portion; and c) a track positioned between extremes of said periphery, and having portions thereof which are moveable relative to said periphery, said at least one of said force transmitting members being operatively associated with said track such that movement of said track portions moves said at least one of said force transmitting members so as to permit both positive and negative adjustment of the acceleration of said flying device; and d) said track comprising a closed loop cable entrained about a system of pulleys.

2. An apparatus useable to control an energy capture device, the apparatus comprising:

a) a main body portion defining a periphery thereof; and which is moveable throughout a range of motion;

b) at least a pair of force transmitting members associated with said main body portion for delivery of force to said energy capture device;

c) a plurality of rotary members;

d) a substantially continuous medium which is in spaced relation to said main body portion and which associates each of said plurality of rotary members with said main body portion; and e) a third force transmitting member in cooperative relation with each of at least one of said plurality of rotary members and said main body portion for enabling variation in the amount of energy captured by said energy capture device.

f) said substantially continuous medium forming a closed loop.

3. An apparatus for controlling a kite, the apparatus comprising:

a) a main body portion defining a periphery thereof and which is moveable throughout a range of motion;

b) a pair of force transmitting members connected to said main body portion for permitting directional control of said kite;

c) an assembly for permitting relative adjustment of the acceleration of said kite, said assembly being responsive to movement of said main body portion, and comprising:

1) a plurality of rotary members, less than the sum thereof maintaining direct connection with said main body portion;

2) a substantially continuous medium advanceable over each of said rotary members; and 3) a force transmitting member adapted for connection with said kite, and operatively connected with at least one of said plurality of rotary members and said main body portion, said at least one of said plurality of rotary members being moveable along portions of said substantially continuous medium in response to movement of said main body portion; and d) said substantially continuous medium forming a closed loop.

4. The apparatus as recited in claim 2, wherein: said force transmitting members and said substantially continuous medium are each constructed of rope.

5. The apparatus as recited in claim 2, wherein: Each of said rotary members is a pulley.

6. The apparatus as recited in claim 3, wherein: said force transmitting members and said substantially continuous medium are each constructed of rope.

7. The apparatus as recited in claim 3, wherein: each of said rotary members is a pulley.

8. An apparatus which controls the velocity and acceleration of a kite, said apparatus comprising:

a) a control bar comprising a pair of ends and which is moveable throughout a range of motion;

b) at least a pair of fly-lines mounted with said control bar for movement in unison therewith so as to enable steering of the kite; and c) an assembly for permitting relative adjustment of the acceleration of said kite, said assembly being responsive to movement of said control bar, and comprising:

1) a closed loop cable;

2) a plurality of pulleys, and said closed loop cable being entrained about said plurality of pulleys; and 3) a brake line adapted for connection with said kite, and which is operatively connected with at least one of said pulleys, said at least one of said pulleys carrying said closed loop cable, and being moveable along portions thereof for moving said brake line in unison with a respective one of said pair of fly-lines.

9. The apparatus as recited in claim 8, wherein:

movement of the control bar in a first direction provides an increase in the acceleration of the kite, and movement of the control bar in a second direction provides a decrease in the acceleration of the kite.

10. An apparatus which controls the velocity and acceleration of a kite, said apparatus comprising:

a) a control bar having a hollow interior and a pair of ends and which is moveable throughout a range of motion;

b) at least a pair of fly-lines mounted to said ends of said control bar for movement in unison therewith so as to enable steering of the kite; and c) an assembly for permitting relative adjustment of the acceleration of said kite, said assembly being responsive to movement of said control bar, and comprising:

1) a cable;

2) a plurality of pulleys mounted within the interior of said control bar, said cable being entrained about said plurality of pulleys; and 3) a brake line adapted for connection with said kite, and a pulley connecting said brake line to said cable whereby said brake line moves in unison with a respective one of said pair of fly-lines.

* * * * *